US010384251B2

(12) United States Patent
Isogai et al.

(10) Patent No.: US 10,384,251 B2
(45) Date of Patent: Aug. 20, 2019

(54) BURRING PROCESSING METHOD

(71) Applicant: NIPPON STEEL & SUMITOMO METAL CORPORATION, Tokyo (JP)

(72) Inventors: Eiji Isogai, Tokyo (JP); Yutaka Mikazuki, Tokyo (JP); Riki Okamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/555,656

(22) PCT Filed: Mar. 9, 2016

(86) PCT No.: PCT/JP2016/057371
§ 371 (c)(1),
(2) Date: Sep. 5, 2017

(87) PCT Pub. No.: WO2016/143820
PCT Pub. Date: Sep. 15, 2016

(65) Prior Publication Data

US 2018/0043412 A1 Feb. 15, 2018

(30) Foreign Application Priority Data

Mar. 11, 2015 (JP) ..... 2015-048169

(51) Int. Cl.
*B21D 28/26* (2006.01)
*B21D 19/08* (2006.01)

(52) U.S. Cl.
CPC ..... *B21D 19/08* (2013.01); *B21D 28/26* (2013.01)

(58) Field of Classification Search
CPC ..... B21D 28/00; B21D 28/24; B21D 28/26; B21D 28/265; B21D 31/02; B21D 22/02;
(Continued)

(56) References Cited

U.S. PATENT DOCUMENTS 4,055,067 A * 10/1977 Kozima ..... B21D 31/02 72/328
4,213,323 A * 7/1980 De Deugd ..... B21C 37/292 72/358

(Continued)

FOREIGN PATENT DOCUMENTS

JP 6-87039 A 3/1994
JP 8-10872 A 1/1996

(Continued)

OTHER PUBLICATIONS

Machine Translation of JP 2001269723 A to Fukaya et al. cited by applicant in IDS.*

(Continued)

*Primary Examiner* — Edward T Tolan
(74) *Attorney, Agent, or Firm* — Birch, Stewart, Kolasch & Birch, LLP

(57) ABSTRACT

In performing burring processing on a sheet-like member, the following processes are performed: a punching process of performing punching processing of the sheet-like member; a hole expansion process of performing hole expansion processing of a punched hole formed by the punching process; a re-punching process of performing punching processing again on a portion surrounding the punched hole expanded by force in the hole expansion process; and a burring process of pushing a portion surrounding a re-punched hole that is a punched hole formed by the re-punching process and forming a vertical wall.

7 Claims, 3 Drawing Sheets

(58) Field of Classification Search
CPC ..... B21D 28/34; B21D 28/343; B21D 19/08; B21D 28/02
See application file for complete search history.

(56) References Cited

U.S. PATENT DOCUMENTS

| | | | | |
|---|---|---|---|---|
| 5,159,826 | A | 11/1992 | Miyazawa et al. | |
| 5,237,849 | A | 8/1993 | Miyazawa | |
| 5,448,832 | A * | 9/1995 | Kanemitsu | B21D 22/04 29/892.2 |
| 7,757,534 | B2 * | 7/2010 | Shiga | B21D 19/088 72/325 |
| 2007/0245796 | A1 * | 10/2007 | Shiga | B21D 22/02 72/312 |
| 2009/0211327 | A1 * | 8/2009 | Kanie | B21D 28/26 72/335 |
| 2013/0152656 | A1 | 6/2013 | Maeda et al. | |
| 2013/0199679 | A1 * | 8/2013 | Toji | B21D 22/02 148/653 |
| 2015/0099139 | A1 * | 4/2015 | Rijkenberg | C22C 38/001 428/659 |

FOREIGN PATENT DOCUMENTS

| | | | |
|---|---|---|---|
| JP | 2001-269723 | A | 10/2001 |
| JP | 2004-223583 | A | 8/2004 |
| JP | 2007-75869 | A | 3/2007 |
| JP | 2008-290085 | A | 12/2008 |
| JP | 2013-126673 | A | 6/2013 |
| JP | 2015-24427 | A | 2/2015 |
| JP | 2015-36147 | A | 2/2015 |
| RU | 69780 | U1 | 1/2008 |
| WO | WO 2013/167572 | A1 | 11/2013 |

OTHER PUBLICATIONS

International Search Report for PCT/JP2016/057371 dated Jun. 7, 2016.
Written Opinion of the International Searching Authority for PCT/JP2016/057371 (PCT/ISA/237) dated Jun. 7, 2016.
Extended European Search Report, dated Oct. 5, 2018, for corresponding European Application No. 16761787.7.
Japanese Office Action, dated Sep. 4, 2018, for corresponding Japanese Application No. 2017-505378, with partial English translation.
Korean Office Action, dated Sep. 17, 2018, for corresponding Korean Application No. 10-2017-7024949, with partial English translation.
Canadian Office Action for corresponding Canadian Application No. 2,977,205, dated Jul. 17, 2018.
Chinese Office Action and Search Report for corresponding Chinese Application No. 201680013703.5, dated Jun. 27, 2018, with a partial English translation of the Office Action.
Russian Office Action and Search Report for corresponding Russian Application No. 2017131516, dated Jul. 19, 2018, with an English translation.
Canadian Office Action for corresponding Canadian Application No. 2,977,205, dated Jan. 31, 2019.
Japanese Office Action for corresponding Japanese Application No. 2017-505378, dated Jan. 8, 2019, with a partial English translation.
Chinese Office Action dated Feb. 22, 2019 in corresponding Chinese Patent Application No. 201680013703.5, with partial English translation.
Korean Office Action dated Mar. 8, 2019 in corresponding Korean Patent Application No. 10-2017-7024949, with partial English translation.

* cited by examiner

BURRING PROCESSING METHOD

TECHNICAL FIELD

The present invention relates to the burring processing to be performed on a sheet-like member.

BACKGROUND ART

A suspension system component or the like of an automobile is produced by performing press processing or other processing on a metal sheet such as a high-tensile steel sheet. In the production process, burring processing that forms a burring hole in the metal sheet may be performed. Conventional burring processing is performed by first forming a punched hole 52 in a metal sheet 51 as shown in FIG. 1, and then forming a vertical wall 53 by expanding the punched hole 52 by force as shown in FIG. 2. In the press process of the vertical wall 53 (hereinafter, "burring process"), large tensile stress acts on the punched hole 52 at the time of expanding the punched hole 52 by force. Hence, in the conventional burring processing method, there has been a case where cracking (hereinafter, "burring cracking") occurs in the vertical wall 53 in the burring process.

To solve this problem, Patent Literature 1 discloses a method in which drawing processing is performed in a press process of the first time so that the metal sheet has a U-shaped cross-sectional shape, then a punched hole is formed in the bottom surface in a press process of the second time, and a vertical wall is formed in a press process of the third time.

Further, Patent Literature 2 discloses a method in which drawing processing is performed while a drawing shoulder radius of a press process of the first time is set large, then the drawing shoulder portion is re-struck in a press process of the second time, and the entire bottom surface is punching-processed in the last stage of the processing.

CITATION LIST

Patent Literature

Patent Literature 1: JP 2004-223583A
Patent Literature 2: JP H6-87039A

SUMMARY OF INVENTION

Technical Problem

However, in the processing method of Patent Literature 1, although the press process of the first time is performed for the purpose of ensuring the height of the vertical wall of the product, there has been a problem that, for example in a hard-to press material such as a high-tensile steel sheet, cracking occurs in the shoulder portion of the bottom surface during drawing processing that is the press process of the first time.

Further, in the processing method of Patent Literature 2, the press process of the first time is performed for the purpose of avoiding cracking occurring in the shoulder portion of the bottom surface; but in the case where, for example, a high-tensile steel sheet is used as the material, like in Patent Literature 1 there has been a problem that cracking occurs in the shoulder portion of the bottom surface during drawing processing that is the press process of the first time.

Thus, in conventional burring processing methods, the material to be processed is limited, and there has been a case where the occurrence of burring cracking cannot be suppressed. Hence, a new burring processing method for suppressing burring cracking has been desired.

The present invention has been made in view of the circumstances mentioned above, and an object of the present invention is to provide a burring processing method that suppresses burring cracking.

Solution to Problem

The present inventors conducted extensive studies on the press forming method that suppresses burring cracking. Consequently, with attention on the fact that the strain generated at the time of expanding the punched hole by force is a cause of burring cracking, the present inventors have found that the problem mentioned above can be solved by removing the strain before the burring process.

That is, the gist of the present invention that solves the above problem is, in performing burring processing on a sheet-like member, the following processes are performed: a punching process of performing punching processing of the sheet-like member; a hole expansion process of performing hole expansion processing of a punched hole formed by the punching process; a re-punching process of performing punching processing again on a portion surrounding the punched hole expanded by force in the hole expansion process; and a burring process of pushing a portion surrounding a re-punched hole that is a punched hole formed by the re-punching process and forming a vertical wall.

The "sheet-like member" in the present invention is a sheet-like member that can be press-formed, and refers to, for example, a steel sheet, an aluminum alloy sheet, a titanium alloy sheet, a stainless steel alloy sheet, a metal sheet of a composite material composed of a metal and a resin, a composite material composed of different metals, or the like, or a member of carbon fibers or the like.

Advantageous Effects of Invention

According to the present invention, burring cracking occurring during the burring processing of a sheet-like member can be suppressed.

DESCRIPTION OF EMBODIMENTS

Figure 1:
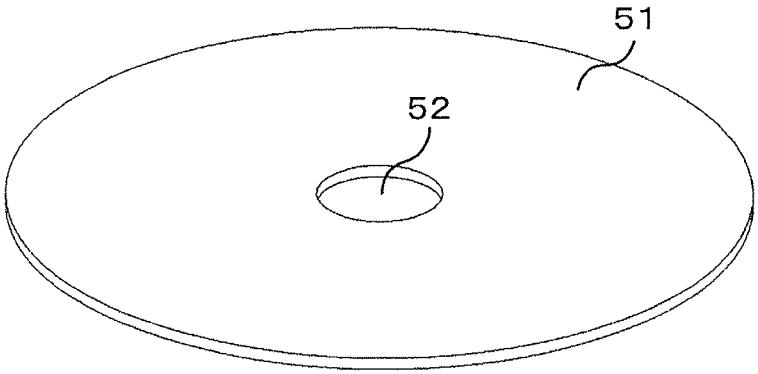
FIG. 1 CONVENTIONAL ART
FIG. 1 is a diagram describing a process of a conventional burring processing method, and is a diagram schematically showing a shape of a sheet-like member in a press process of the first time.
Figure 2:
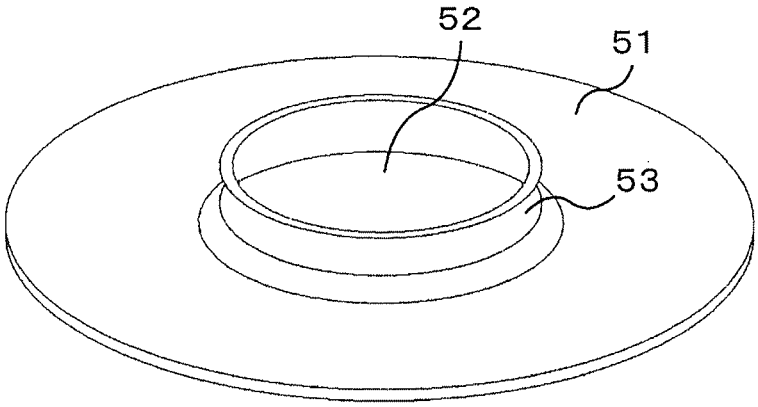
FIG. 2 CONVENTIONAL ART
FIG. 2 is a diagram describing a process of the conventional burring processing method, and is a diagram schematically showing a shape of the sheet-like member in a press process of the second time.

Hereinbelow, a burring processing method according to an embodiment of the present invention is described with reference to the drawings. In the present specification and the drawings, components having substantially the same functional configuration are marked with the same reference numerals, and a repeated description is omitted.

The burring processing method according to the present embodiment performs press processes four times on a sheet-like member. Details of each process are as follows.

<Punching Process>

Figure 3:
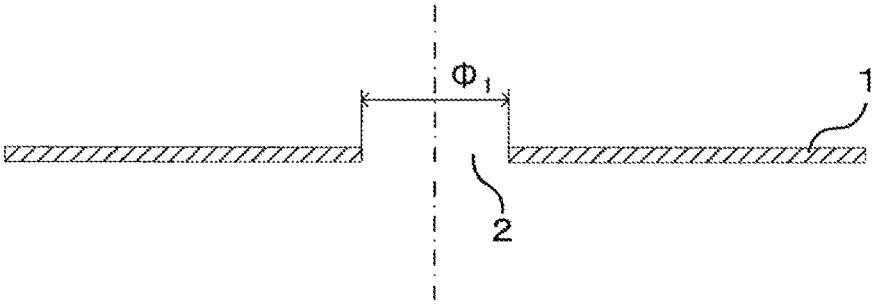
FIG. 3 is a diagram describing a process of a burring processing method according to an embodiment of the present invention, and is a cross-sectional view schematically showing a shape of a sheet-like member in a press process of the first time.

In the burring processing method of the present embodiment, first, punching processing is performed on a sheet-like member as the press process of the first time. Thereby, an intermediate product 1 having a punched hole 2 with a hole diameter of $\Phi_1$ like that shown in FIG. 3 is obtained. The hole diameter $\Psi$ at this time is smaller than the hole diameter of the punched hole 52 in conventional burring processing like FIG. 1.

<Hole Expansion Process>

Figure 4:
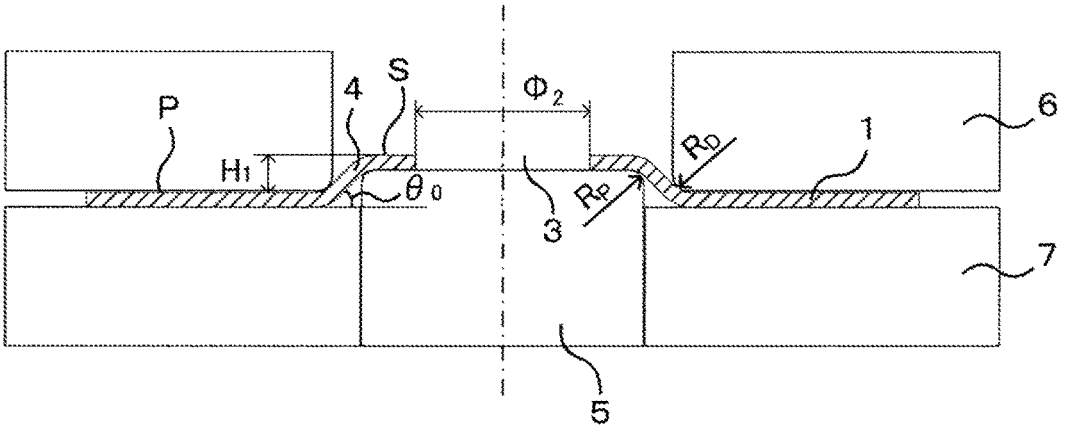
FIG. 4 is a diagram describing a process of the burring processing method according to the an embodiment of the present invention, and is a cross-sectional view schematically showing a shape of the sheet-like member in a press process of the second time. In the present drawing, only the sheet-like member is hatched, and the hatching of the constituent components of a press forming is omitted.

Next, as shown in FIG. 4, the hole expansion processing of the punched hole 2 is performed by, as the press process of the second time of the present embodiment, pressing a portion surrounding the punched hole 2 using a cylindrical punch 5. Thereby, an intermediate product 1 having a punched hole 3 with a hole diameter of $\Phi_2$ is obtained. In the intermediate product 1, the strain of a portion surrounding the punched hole 3 has been increased by the portion surrounding the punched hole 2 before hole expansion being expanded by force. In the following description, the portion where the strain of the portion surrounding the punched hole 3 has been increased is referred to as a "strain concentration portion."

In the hole expansion process, the portion surrounding the punched hole 2 before hole expansion is pressed, and thereby a surface S in which the punched hole 3 is formed is made higher than a basal plane P of the blank. Thereby, a vertical wall-corresponding portion 4 that is a portion corresponding to a vertical wall 9 (FIG. 6) after burring process to be described later is formed. The "basal plane" refers to the horizontal plane in the fixing position of the sheet-like member that is fixed to a die 6 by a holder 7. In the following description, the height from the basal plane P to the surface S in which the punched hole 3 is formed is referred to as "height of the vertical wall-corresponding portion."

If the height $H_1$ of the vertical wall-corresponding portion 4 is set too low in the hole expansion process, the vertical wall height $H_3$ cannot be sufficiently ensured. On the other hand, if the height $H_1$ of the vertical wall-corresponding portion 4 is set too high, the strain generated in the portion surrounding the punched hole 3 is excessively increased, and cracking may occur in the portion surrounding the punched hole 3 during hole expansion processing. Hence, the height $H_1$ of the vertical wall-corresponding portion 4 of the hole expansion process is preferably set in view of the vertical wall height $H_3$ and the hole expandability of the material, as appropriate. In the present embodiment, the height $H_1$ of the vertical wall-corresponding portion 4 is lower than the height $H_3$ of the vertical wall 9.

If the angle $\theta_0$ (hereinafter, "angle of the vertical wall-corresponding portion") between the inclined surface of the vertical wall-corresponding portion 4 and the basal plane P is set too large in the hole expansion process, the strain generated in the portion surrounding the punched hole 3 is excessively increased. On the other hand, if the angle $\theta_0$ of the vertical wall-corresponding portion is set too small in the hole expansion process, it is necessary that the angle at which the vertical wall-corresponding portion 4 is stood at the time of forming the vertical wall 9 in the burring process to be described later be set large. In this case, the strain of the terminal portion of the vertical wall is increased, and burring cracking may occur. Hence, in the hole expansion process, press forming is preferably performed such that the angle $\theta_0$ of the vertical wall-corresponding portion 4 is an angle of 20 to 70% relative to the angle $\theta$ (hereinafter, "vertical wall angle") between the vertical wall 9 and the basal plane P of the finish product shown in FIG. 6.

To suppress the cracking of the portion surrounding the punched hole 3 in the hole expansion process, the size of the shoulder radius of the punch 5 and the die 6 is preferably as small as possible. However, if the shoulder radius of the punch 5 and the die 6 is too small, cracking may occur during hole expansion processing, depending on the material. Hence, a shoulder radius $R_P$ of the punch 5 and a shoulder radius $R_D$ of the die 6 in the hole expansion process are preferably set in view of the bendability of the material, as appropriate.

<Re-Punching Process>

Figure 5:
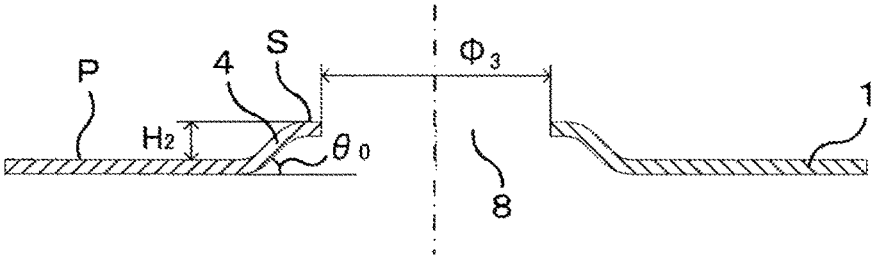
FIG. 5 is a diagram describing a process of the burring processing method according to an embodiment of the present invention, and is a cross-sectional view schematically showing a shape of the sheet-like member in a press process of the third time.

After the hole expansion process is finished, punching processing that presses and punches a portion surrounding the punched hole 3 is performed as the press process of the third time of the present embodiment. Thereby, an intermediate product 1 having a punched hole 8 with a hole diameter of $\Phi_3$ like that shown in FIG. 5 is obtained. In the present specification, the present process that performs punching processing again after the hole expansion process is referred to as a "re-punching process." Further, in the following description, the punched hole formed by the re-punching process is referred to as a "re-punched hole."

By the present process, a portion surrounding the punched hole 3 (FIG. 4) formed by the hole expansion process described above is punched. Thereby, the strain concentration portion around the punched hole that is brought about in the hole expansion process is removed. That is, a portion surrounding the re-punched hole 8 (FIG. 5) of the intermediate product 1 obtained by the present process has a smaller strain than the portion surrounding the punched hole 3 after the hole expansion process. Hence, even when the strain of the terminal portion of the vertical wall is increased by the burring process to be described later, the accumulation of strain can be made smaller than in the past, and therefore burring cracking is less likely to occur.

In the re-punching process in the present embodiment, punching processing is performed such that the surface S in which the punched hole 3 is formed after the finishing of the hole expansion process is left. Alternatively, in the re-punching process, processing may be performed such that the punched hole formation surface S does not remain, for example by punching the inclined portion of the vertical wall-corresponding portion 4. Also in this case, the strain concentration portion of the vertical wall-corresponding portion 4 can be removed, and therefore burring cracking can be suppressed. However, when punching processing in such a manner that the punched hole formation surface S does not remain is performed in the re-punching process, the punching tool may be damaged, and the surface around the punched hole 8 may be flawed. The flaw is a cause of cracking in the burring process to be described later; thus, in order to improve the effect of burring cracking suppression, it is preferable that, in the re-punching process, the portion surrounding the punched hole 3 be punched such that the punched hole formation surface S remains.

Due to the punching of the punched hole formation surface S or the inclined portion of the vertical wall-corresponding portion 4 in the punching processing in the re-punching process, the height $H_2$ of the vertical wall-corresponding portion 4 after the finishing of the re-punching process is substantially the same as the height $H_1$ of the vertical wall-corresponding portion 4 in the hole expansion process described above, or is lower than the height $H_1$. The diameter of the punch used in the re-punching process is preferably set sufficiently larger than the diameter of the punch used in the punching process described above so that the strain concentration portion of the punched hole 3 can be removed. If the difference between the punch diameter of the punching process and the punch diameter of the re-punching process is too small, the strain concentration portion of the punched hole 3 cannot be sufficiently removed. In this case, a situation where, in the burring process to be described later, the vertical wall-corresponding portion 4 is stood while the strain concentration portion remains around the re-punched hole 8 is caused; consequently, the strain accumulated in the strain concentration portion is further increased, and burring cracking is likely to occur.

<Burring Process>

Figure 6:
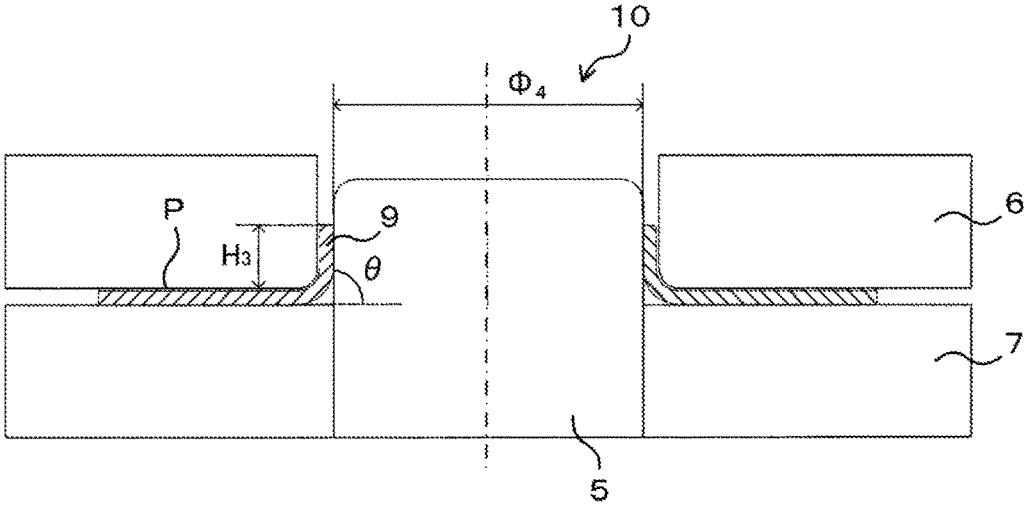
FIG. 6 is a diagram describing a process of the burring processing method according to the an embodiment of the present invention, and is a cross-sectional view schematically showing a shape of the sheet-like member in a press process of the fourth time. In the present drawing, only the sheet-like member is hatched, and the hatching of the constituent components of a press forming is omitted.

After the re-punching process is finished, burring processing that, as shown in FIG. 6, pushes a portion surrounding the re-punched hole 8 to stand the vertical wall-corresponding portion 4 (FIG. 5) and forms a vertical wall 9 is performed as the press process of the fourth time of the present embodiment. Thereby, a press component of the final shape like that shown in FIG. 6 in which a burring hole 10 with a hole diameter of $\Phi_4$ is formed is obtained.

As above, according to the burring processing method of the present embodiment, the strain concentration portion around the punched hole that is brought about in the hole expansion process is once removed by the re-punching process. As a result, the strain accumulated in the terminal portion of the vertical wall in the burring process is made smaller than in the past, and the occurrence of burring cracking can be suppressed.

By using the burring processing method of the present embodiment capable of suppressing the occurrence of burring cracking, a high-strength material excellent in hole expandability is easily processed into the same shape as a product shape in the case where a low-strength material is used, as compared to the case where a conventional processing method is used. For example, in the case where burring processing is performed on a steel sheet with a tensile strength of the 590-MPa class that has a hole expansion ratio substantially equal to the hole expansion ratio of a steel sheet of the 440-MPa class, a processing method like conventional ones in which a blank is punched and is then burring-formed as it is may cause burring cracking when it is attempted to process the blank into the same shape as a product shape in the case where a steel sheet of the 440-MPa class is used. On the other hand, in the burring processing method of the present embodiment, even when such a steel sheet is used, the steel sheet can be processed into the same shape as a product shape in the case where a steel sheet of the 440-MPa class is used, without causing burring cracking. That is, it becomes possible to produce a component in which burring substantially similar to a burring shape in the case where a steel sheet of the 440-MPa class is used, which conventional processing methods have failed to obtain, is formed and exclusively the strength is improved. Hence, the flexibility of product design can be expanded.

Each of the punching process, the hole expansion process, the re-punching process, and the buffing process themselves described in the present embodiment is a process usually performed also in conventional component production processes. That is, the burring processing method of the present embodiment can be used for a conventional component production process without adding a special process. For example, in the case where the number of processes needed to produce a component is six, the punching process, the hole expansion process, the re-punching process, and the burring process mentioned above are processes usually included in the six processes. Hence, in the case where, for example, the punching process according to the present embodiment is performed, press forming may be performed such that another punched hole for burring processing is formed in addition to a punched hole originally formed by a conventional punching process. This similarly applies to the other processes of the hole expansion process, the re-punching process, and the burring process. That is, for the burring processing of the present embodiment, there is no need to add another process to the conventional six processes; thus, the burring processing method according to the present embodiment can suppress burring cracking without reducing productivity.

The burring processing method of the present embodiment is particularly useful in the case where the material to be burring-processed is a high-tensile steel sheet (for example, one with a tensile strength of 440 MPa or more). In the case where the material to be burring-processed is a high-tensile steel sheet, the expansion properties of the material are worsened; hence, in conventional processing methods, cracking may occur in the course of processing and burring cannot be formed, or even if burring is successfully formed, burring cracking is likely to occur. On the other hand, in the burring processing method of the present embodiment, re-punching processing that removes strain is performed before burring process; therefore, even in a high-tensile steel sheet, burring can be formed and burring cracking can be suppressed. That is, in the case where the material to be burring-processed is a high-tensile steel sheet, the effect of burring cracking suppression of the present invention compared to conventional technology is exhibited significantly.

Further, the burring processing method of the present embodiment is particularly useful in the case where the material to be burring-processed is a hot rolled steel sheet. In a case where, for example, burring processing is performed on a cold rolled steel sheet, burring can be formed by processing such as stretch processing, punching processing, or burring processing. However, if such a processing method is used for a hot rolled steel sheet at the time of producing a component in which the vertical wall height $H_3$ of the burring portion is high, it is feared that burring cannot be formed. On the other hand, a hot rolled steel sheet has excellent hole expansion properties ($\lambda$ value), and the burring processing method of the present embodiment is a processing method utilizing the hole expandability of the material. Hence, by using the burring processing method of the present embodiment for a hot rolled steel sheet, burring can be easily formed even in the case where a component in which the vertical wall height $H_3$ of the burring portion is high is produced, and the effect of burring cracking suppression of the present invention compared to conventional technology is exhibited significantly.

In order to further suppress cracking during hole expansion processing or during burring processing, it is important to make the punching surface condition good. As the method for making the end surface condition good, it is preferable that, in at least either one of the punching process and the re-punching process, at least either one of machining processing such as reaming processing and laser processing be performed as finish processing that removes a burr or the like of the punched hole. Thereby, the occurrence of burring cracking can be further suppressed.

Hereinabove, preferred embodiments of the present invention are described; but the present invention is not limited to these examples. It is clear that one skilled in the art can arrive at various alteration examples or modification examples within the technical idea described in the scope of claims; those should be seen as within the technical scope of the present invention, as a matter of course.

For example, although in the above embodiment, the punching process, the hole expansion process, the re-punching process, and the burring process are performed by four times of pressing, the number of times of pressing is not limited to this. For example, in the hole expansion process, hole expansion processing may be performed such that a desired hole diameter is obtained by two times of pressing.

Further, although in the hole expansion process in the above embodiment, hole expansion processing is performed such that the height $H_1$ of the vertical wall-corresponding portion 4 is made lower than the vertical wall height $H_3$, hole expansion processing may be performed such that the height $H_1$ of the vertical wall-corresponding portion 4 is higher than or equal to the vertical wall height $H_3$. Even in this case, the strain concentration portion around the punched hole that is brought about due to hole expansion processing can be once removed, and therefore burring cracking in the burring process can be suppressed.

Further, although in the above embodiment, burring processing is performed such that the vertical wall angle θ of the burring portion is perpendicular, the vertical wall angle θ may not be perpendicular. Burring cracking occurs due to strain generated at the time of pressing a portion surrounding the punched hole and forming a vertical wall; therefore, even in a shape in which the vertical wall is inclined with respect to a plane perpendicular to the basal plane P toward the center of the burring hole, a strain concentration portion is formed in the terminal portion of the vertical wall. On the other hand, in the burring processing method according to the present invention, even when the shape of the final product is such a shape, burring cracking can be suppressed because burring processing is performed after the strain concentration portion is once removed.

However, the larger the angle at which the vertical wall 9 is stood in the burring process shown in FIG. 6 is, the larger the strain of the terminal portion of the vertical wall 9 is. That is, at the time of, in the burring process, performing press forming in such a manner that the vertical wall angle θ is perpendicular, burring cracking is likely to occur. In conventional processing methods, since the strain concentration portion is left in the burring process, burring cracking cannot be sufficiently suppressed. On the other hand, in the burring processing method according to the present invention, even when burring forming in such a manner that the vertical wall angle θ is perpendicular is performed, burring cracking can be suppressed because the strain concentration portion is removed in the re-punching process. That is, at the time of, in the burring process, forming burring in which the vertical wall angle θ is perpendicular, the effect of burring cracking suppression according to the present invention is exhibited significantly, compared to conventional technology. In the present specification, "perpendicular" in regard to the vertical wall angle θ is not perpendicular in a strict sense, but is a term including the concept of substantially perpendicular.

EXAMPLES

Example 1

As Example according to the present invention, using a steel sheet with a sheet thickness of 3.0 mm and a tensile strength of the 780 MPa class, a burring test was performed on a blank with a diameter of 180 mm.

The forming method of Example 1 is as follows. First, a punched hole with a diameter of 35 mm was formed in the press process of the first time. Next, in the press process of the second time, hole expansion processing by a stroke of 12 mm was performed using a press forming composed of a cylindrical punch with a diameter of 60 mm and a die with a shoulder radius of 3 mm. After that, in the press process of the third time, punching processing was performed on a portion surrounding the punched hole that had been expanded to a diameter of 42 mm by the hole expansion processing, and thus a punched hole with a diameter of 57 mm was formed. In the press process of the fourth time serving as the final process, press forming was performed using a burring punch with a diameter of 70 mm. The height of the final burring portion was set to 15 mm.

After that, the presence or absence of burring cracking was evaluated for the member obtained by the press forming. Also the strain of a terminal portion of the vertical wall at that time was measured. The strain of the terminal portion of the vertical wall was calculated from the shape change of a scribed circle that had been transferred to the surface of the blank to be burring-processed.

In Example 1, it has been found that burring cracking did not occur in the member after the press forming. The strain of the terminal portion of the vertical wall was 28%.

Comparative Example 1

Next, as Comparative Example 1, a burring test was performed using a blank of the same material and the same size as Example 1. First, in the press process of the first time, a punched hole with a diameter of 47 mm was formed so as to obtain the same shape as Example 1 mentioned above. After that, as the press process of the second time, press forming was performed using a burring punch with a diameter of 70 mm. The resulting member was evaluated in a similar manner to Example 1, and it has been found that burring cracking occurred in Comparative Example 1. Further, it has been found that the strain of a part where cracking did not occur was as high as 40%.

Comparative Example 2

As Comparative Example 2, using a blank of the same material and the same size as Example 1, a burring test was performed by the processing method described in Patent Literature 1. First, in the press process of the first time, stretch forming by a stroke of 12 mm was performed using a press forming composed of a cylindrical punch with a diameter of 60 mm and a die with a shoulder radius of 3 mm. However, in Comparative Example 2, cracking occurred in a shoulder portion of the bottom surface of the material in the press process of the first time, and it was impossible to continue the processing any longer; consequently, it was impossible to form burring.

As shown in the result of Example 1, it can be seen that, according to the burring processing method according to the present invention, the amount of strain generated in the burring edge portion of the press component can be reduced, and burring cracking can be suppressed.

Example 2

Next, using a blank of the same material and the same size as Example 1, machining processing was performed as the finish processing of a punched hole formed in the material, and a press forming test was performed. The conditions other than performing machining processing on the punched hole are similar to conditions of Example 1. As a result, it has been found that the amount of minute cracks occurring in the end surface of the product after the burring processing was small, as compared to a processed product in which machining processing was not performed. From the result of Example 2, it can be seen that it is preferable to, in at least either one of the punching process and the re-punching process, perform machining processing or laser processing as finish processing that removes a burr or the like.

INDUSTRIAL APPLICABILITY

The present invention can be applied to the burring processing of a sheet-like member such as a high-tensile steel sheet. A sheet-like member that has undergone burring processing according to the present invention can be used as a member of various vehicles including automobiles, general machines, home electrical appliances, ships, and the like.

REFERENCE SIGNS LIST

1 intermediate product
2 punched hole
3 punched hole after hole expansion
4 vertical wall-corresponding portion
5 punch
6 die
7 holder
8 re-punched hole
9 vertical wall
10 burring hole
51 metal sheet
52 punched hole
53 vertical wall
$H_1$ height of vertical wall-corresponding portion
$H_2$ height of vertical wall-corresponding portion after re-punching
$H_3$ vertical wall height
S punched hole formation surface
P basal plane
$R_D$ shoulder radius of die
$R_P$ shoulder radius of punch
$\Phi_1$ diameter of punched hole
$\Phi_2$ diameter of punched hole after hole expansion
$\Phi_3$ diameter of re-punched hole
$\Phi_4$ diameter of burring hole
$\theta$ vertical wall angle
$\theta_0$ angle of vertical wall-corresponding portion

The invention claimed is:

1. A burring processing method of a sheet member, comprising:

a punching process of performing punching processing of the sheet member;

a hole expansion process of performing hole expansion processing of a punched hole formed by the punching process by putting and fixing the sheet member around the punched hole between a die and a holder;

a re-punching process of performing punching processing again on a portion surrounding the punched hole expanded by force in the hole expansion process; and a burring process of pushing a portion surrounding a re-punched hole that is a punched hole formed by the re-punching process and forming a vertical wall wherein the punching process performs a punching processing of the sheet member to form a hole of a particular diameter, and the re-punching process performs punching processing again on a portion surrounding the punched hole expanded by force in the hole expansion process removes material around the hole to form a hole with a greater diameter.

2. The burring processing method according to claim 1, wherein, in the re-punching process, the portion surrounding the punched hole is punched such that a surface in which the punched hole is formed after finishing of the hole expansion process remains.

3. The burring processing method according to claim 1, wherein the sheet member is a high-tensile steel sheet.

4. The burring processing method according to claim 1, wherein the sheet member is a hot rolled steel sheet.

5. The burring processing method according to claim 1, wherein, in the burring process, the vertical wall is formed such that a vertical wall angle is perpendicular to a basal plane of the sheet member.

6. The burring processing method according to claim 1, wherein, in the punching process, at least either one of machining processing and laser processing is performed as finish processing of the punched hole.

7. The burring processing method according to claim 1, wherein, in the re-punching process, at least either one of machining processing and laser processing is performed as finish processing of the re-punched hole.

* * * * *